US010409217B2

(12) United States Patent
Nakajima

(10) Patent No.: US 10,409,217 B2
(45) Date of Patent: Sep. 10, 2019

(54) ADSORBING MEMBER, FIXING DEVICE AND IMAGE FORMING APPARATUS INCLUDING THE SAME

(71) Applicant: KYOCERA Document Solutions Inc., Osaka (JP)

(72) Inventor: Eiji Nakajima, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 58 days.

(21) Appl. No.: 15/793,447

(22) Filed: Oct. 25, 2017

(65) Prior Publication Data

US 2018/0173152 A1 Jun. 21, 2018

(30) Foreign Application Priority Data

Dec. 19, 2016 (JP) ..... 2016-245095

(51) Int. Cl.

| | |
|---|---|
| ***G03G 21/00*** | (2006.01) |
| ***G03G 21/20*** | (2006.01) |
| ***G03G 15/02*** | (2006.01) |
| ***G03G 15/20*** | (2006.01) |

(52) U.S. Cl.

CPC ..... *G03G 21/20* (2013.01); *G03G 15/0258* (2013.01); *G03G 15/0283* (2013.01); *G03G 15/2025* (2013.01); *G03G 21/0005* (2013.01); *G03G 15/2053* (2013.01)

(58) Field of Classification Search

CPC ..... G03G 15/2017; G03G 15/2025; G03G 15/2053; G03G 21/20; G03G 21/206; G03G 2221/0005; G03G 2221/0068

See application file for complete search history.

(56) References Cited

U.S. PATENT DOCUMENTS

| | | | | |
|---|---|---|---|---|
| 5,310,593 | A * | 5/1994 | Tsujimoto | B01J 20/20 428/120 |
| 5,667,713 | A * | 9/1997 | Kuma | B01D 53/0407 219/544 |
| 2002/0170436 | A1* | 11/2002 | Keefer | B01J 20/183 96/121 |
| 2006/0042467 | A1* | 3/2006 | Maru | B01D 53/0407 96/134 |
| 2012/0141173 | A1* | 6/2012 | Iwasaki | G03G 15/2025 399/327 |
| 2014/0193171 | A1* | 7/2014 | Park | G03G 15/2017 399/98 |

FOREIGN PATENT DOCUMENTS

| | | | |
|---|---|---|---|
| JP | 09311572 | A * | 12/1997 |
| JP | 2000-305388 | A | 11/2000 |

* cited by examiner

*Primary Examiner* — Thomas S Giampaolo, II

(74) *Attorney, Agent, or Firm* — Studebaker & Brackett PC

(57) ABSTRACT

An adsorbing member includes a plurality of adsorbing sheets and a plurality of spacers. The plurality of adsorbing sheets adsorb a floating matter. The plurality of spacers are each provided between the adsorbing sheets to form a laminate that the plurality of adsorbing sheets are overlapped via a gap.

4 Claims, 11 Drawing Sheets

ADSORBING MEMBER, FIXING DEVICE AND IMAGE FORMING APPARATUS INCLUDING THE SAME

INCORPORATION BY REFERENCE

This application is based on and claims the benefit of priority from Japanese Patent application No. 2016-245095 filed on Dec. 19, 2016, which is incorporated by reference in its entirety.

BACKGROUND

The present disclosure relates to an adsorbing member, a fixing device and an image forming apparatus including the same.

An electrophotographic type image forming apparatus includes a fixing device which heats and presses a medium passing through a nip between a rotatable fixing member and a rotatable pressing member, and fixes a toner image on the medium. An outer face of the fixing member is made of electrical insulation material, and may be electrified to an opposite polarity of the toner by friction with the medium passing through the nip. Then, the toner transferred on the medium adheres to the outer face of the fixing member and then is transferred on the medium passing through the nip. This causes an offset phenomenon.

In order to suppress the offset phenomenon, a corotron charging device may be provided. The corotron charging device electrifies a surface of a fixing film in which a heater is stored, to the same polarity as the toner. By electrifying the fixing film to the same polarity as the toner, the toner transferred on a recording body (the medium) is prevented from being attracted to the fixing film.

By the way, when the toner image is heated, a component of the toner (for example, wax) is volatilized into a floating matter floating around the fixing device. If the floating matter may adhere to an electrode of the corotron charging device, it becomes difficult to electrify the fixing film evenly in an axis direction of the electrode. Such a floating matter can be adsorbed and collected by an activated carbon sheet. However, if the activated carbon sheet is thin, because an amount of the adsorbed floating matter is small, it is difficult to adsorb the floating matter for a long period.

SUMMARY

In accordance with an aspect of the present disclosure, an adsorbing member includes a plurality of adsorbing sheets and a plurality of spacers. The plurality of adsorbing sheets adsorb a floating matter. The plurality of spacers are each provided between the adsorbing sheets and overlap the plurality of adsorbing sheets via a gap to form a laminate.

In accordance with an aspect of the present disclosure, a fixing device includes a fixing member, a pressing member, a charging unit and an adsorbing member. The fixing member heats a toner image on a medium while rotating around an axis. The pressing member forms a nip with the fixing member and presses the medium passing through the nip while rotating around an axis. The charging unit electrifies the fixing member to the same polarity as a toner of the toner image. The adsorbing member is provided on a downstream side of the nip in a rotating direction of the fixing member and on an upstream side of the charging unit in the rotating direction of the fixing member. The adsorbing member includes a plurality of adsorbing sheets and a plurality of spacers. The plurality of adsorbing sheets adsorb a floating matter floating around the fixing member. The plurality of spacers are each provided between the adsorbing sheets, and the plurality of adsorbing sheets are overlapped via a gap to form a laminate.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to the attached drawings, an embodiment of the present disclosure will be described. A near side of a paper plan of FIG. 1 and the others is defined to be a front side of a color printer 1, and Fr, Rr, L, R, U and D shown in each figure respectively show the front, rear, left, right, upper and lower sides of the color printer 1.

Figure 1:
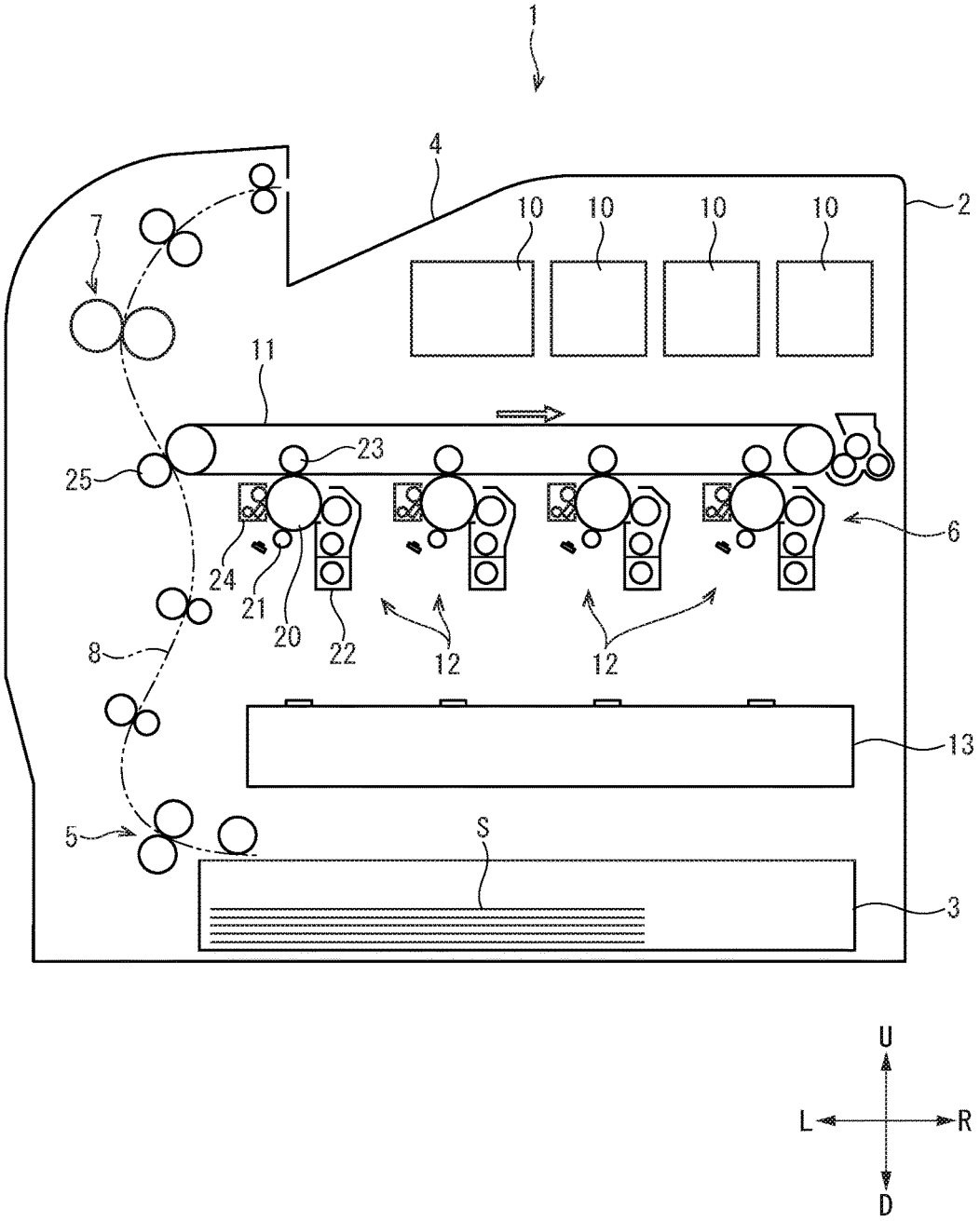
FIG. 1 is a sectional view schematically showing an inner structure of a color printer according to one embodiment of the present disclosure.

<An entire structure of the color printer> With reference to FIG. 1, an entire structure of the color printer 1 as an example of the image forming apparatus will be described. FIG. 1 is a sectional view schematically showing an inner structure of the color printer 1.

The color printer 1 includes an apparatus main body 2 which forms an approximate parallelepiped shaped exterior of the color printer 1. In a lower portion of the apparatus main body 2, a sheet feeding cassette 3 in which a paper sheet S (a bundle of paper sheets) is stored is detachably provided. On an upper face of the apparatus main body 2, an ejected sheet tray 4 is provided. The sheet S as an example of a medium is not limited to the paper sheet, and may contain a resin sheet or the like.

The color printer 1 further includes a sheet feeding part 5, an image forming part 6 and a fixing device 7 which are provided inside the apparatus main body 2. The sheet feeding part 5 is provided at an upstream end portion of a conveying path 8 extending from the sheet feeding cassette 3 to the ejected sheet tray 4. The fixing device 7 is provided at a middle portion of the conveying path 8. The image forming part 6 is provided on the conveying path 8 between the sheet feeding part 5 and the fixing device 7.

The image forming part 6 includes four toner containers 10, an intermediate transferring belt 11, four drum units 12 and an optical scanning device 13. The toner containers 10 are arranged below the ejected sheet tray 4, and each contains a toner (a developer) of each of four colors (yellow, magenta, cyan and black). The intermediate transferring belt 11 is provided in a rotatable manner below the toner containers 10. The drum units 12 are arranged below the intermediate transferring belt 11. The optical scanning device 13 is arranged below the drum units 12.

Each drum unit 12 includes a photosensitive drum 20, a charging device 21, a developing device 22, a primary transferring roller 23 and a cleaning device 24. The charging device 21 electrifies a surface of the photosensitive drum 20. The photosensitive drum 20 is exposed with scanning light emitted from the optical scanning device 13 to carry an electrostatic latent image. The developing device 22 develops the electrostatic latent image on the photosensitive drum 20 into a toner image. The primary transferring roller 23 primarily transfers the toner image on the photosensitive drum 20 to the rotating intermediate transferring belt 11. On the intermediate transferring belt 11, the four color toner images are overlapped into a full color toner image. With a left side portion of the intermediate transferring belt 11, the second transferring roller 25 comes in contact to form a second transferring nip. The sheet S is fed to the conveying path 8 by the sheet feeding part 5 from the sheet feeding cassette 3. The full color toner image is secondly transferred on the sheet S passing through the second transferring nip, and then fixed on the sheet S when the sheet S is passed through the fixing device 7. Then, the sheet S is ejected on the ejected sheet tray 4. The cleaning device 24 removes the toner remained on the photosensitive drum 20 after the toner image is transferred on the intermediate transferring belt 11.

Figure 2:
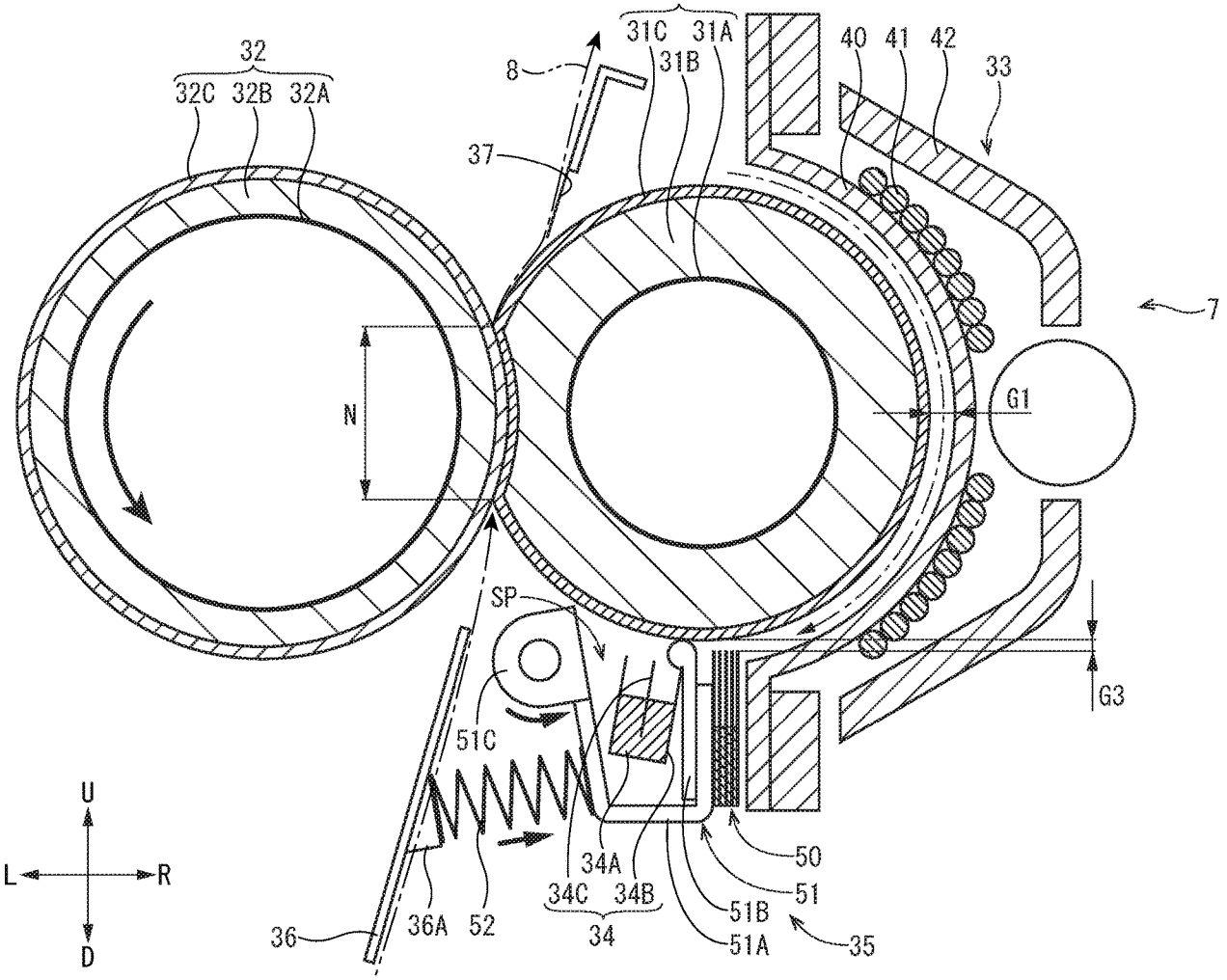
FIG. 2 is a sectional view schematically showing a fixing device according to a first embodiment of the present disclosure.
Figure 3:
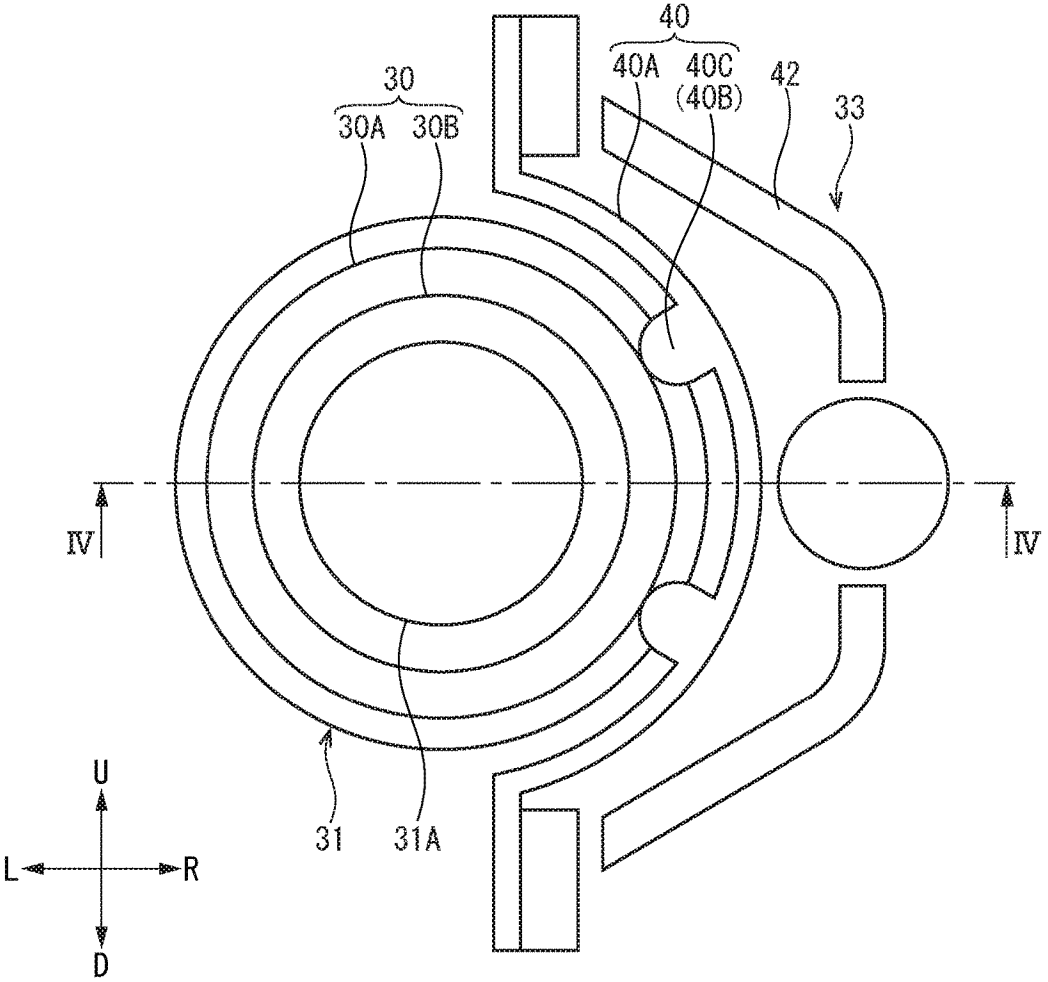
FIG. 3 is a front view schematically showing a fixing roller and the others of the fixing device according to the first embodiment of the present disclosure.
Figure 4:
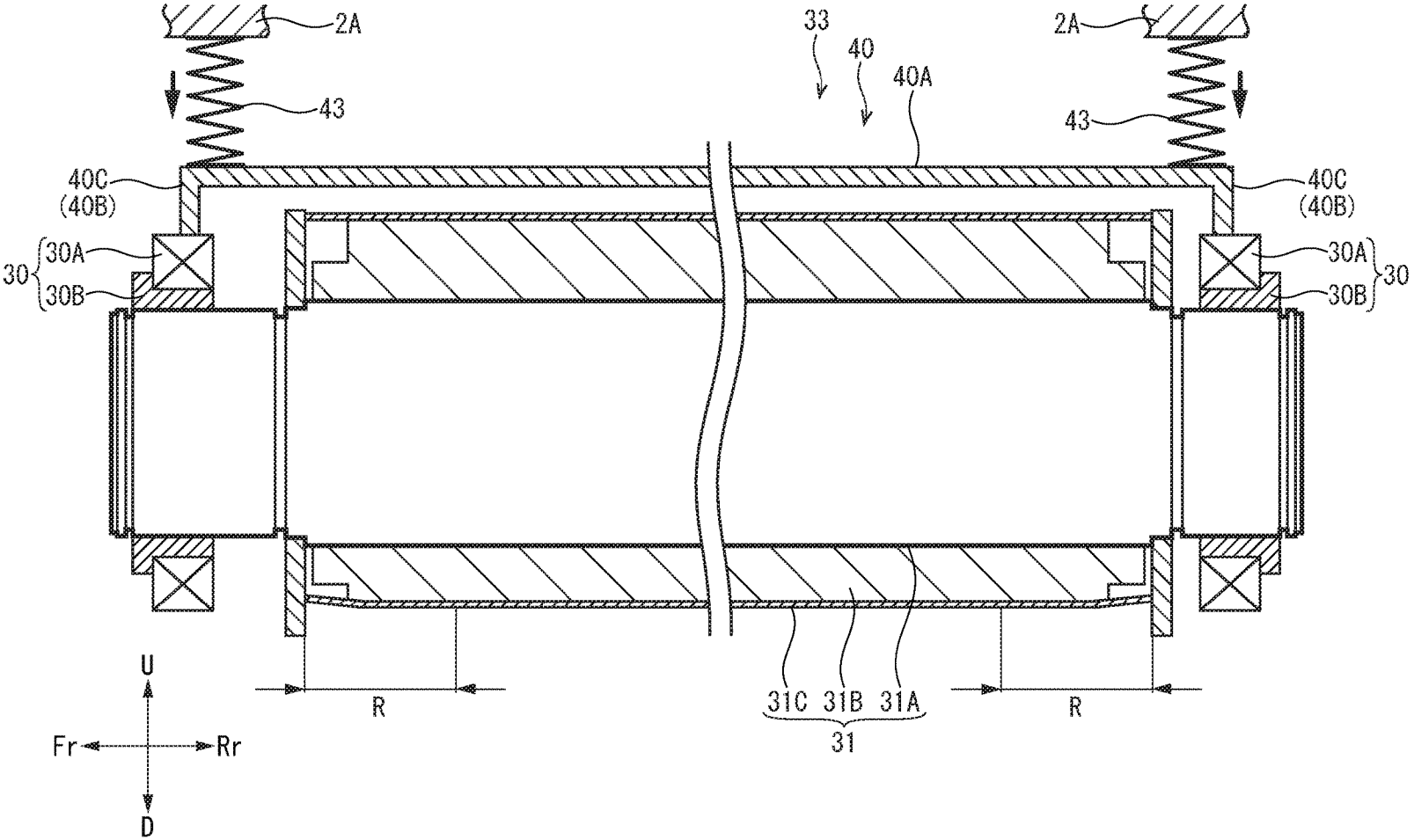
FIG. 4 is a sectional view taken along a line IV-IV of FIG. 3.

<Configuration of the fixing device according to a first embodiment> With reference to FIG. 2 to FIG. 4, a configuration of the fixing device 7 will be described. FIG. 2 is a sectional view schematically showing the fixing device 7. FIG. 3 is a front view schematically showing a fixing roller 31 and the others of the fixing device 7. FIG. 4 is a sectional view taken along a line IV-IV of FIG. 3.

As shown in FIG. 2, the fixing device 7 includes a positioning member 30 (refer to FIG. 3), a fixing roller 31, a pressing roller 32, a heating unit 33, a charging unit 34 and an adsorbing unit 35. The positioning member 30 is a member configured to support the fixing roller 31 in a rotatable manner (refer to FIG. 3). The fixing roller 31 and the pressing roller 32 are approximate cylindrical shaped members elongated in the front-and-rear direction. The heating unit 33 is a device configured to heat the fixing roller 31. The charging unit 34 is a device configured to electrify a surface of the fixing roller 31. The adsorbing unit 35 is a device configured to adsorb a volatile component of the toner.

As shown in FIG. 3 and FIG. 4, the positioning member 30 includes a pair of metal plates (not shown), a pair of bearings 30A and a pair of bushes 30B.

The metal plates are arranged at an interval in the front-and-rear direction, and fixed to a frame (not shown) of the apparatus main body 2. Each of the bearings 30A is a ball bearing, for example, and fixed to the metal plate. The bearings 30A support both end portions in the front-and-rear direction (an axis direction) of the fixing roller 31 (a core metal 31A of the fixing roller 31) in a rotatable manner. Each of the bushes 30B has an approximate annular shape, and is made of heat resistant resin, for example. The bush 30B is provided between the bearing 30A and the core metal 31A. The bush 30B inhibits heat from being transferred from the fixing roller 31 to the bearings 30A, the metal plates and the others.

As shown in FIG. 2, the fixing roller 31 as an example of a fixing member (a rotating member) includes the fixing core metal 31A, a fixing elastic layer 31B and a fixing belt 31C.

The fixing core metal 31A is formed into an approximate cylindrical shape, and made of metal material, for example. Both front and rear end portions of the fixing core metal 31A are supported by the bearings 30A via the bushes 30B (refer to FIG. 4). The fixing elastic layer 31B is made of silicon rubber, for example, and laminated on an outer face of the fixing core metal 31A. The fixing belt 31C covers the fixing elastic layer 31B. The fixing belt 31C includes a substrate (for example, nickel), an elastic layer (silicon rubber, for example) provided on the substrate and a releasing layer (PFA tube, for example) covering the elastic layer.

The pressing member 32 as an example of a pressing member includes a pressing core metal 32A, a pressing elastic layer 32B and a pressing releasing layer 32C.

The pressing core metal 32A is formed into an approximate cylindrical shape, and made of metal material, for example. Both front and rear end portions of the pressing core metal 32A are supported by a pair of movable metal plates (not shown) in a rotatable manner. The pressing elastic layer 32B is made of silicon rubber, for example, and laminated on an outer face of the pressing core metal 32A. The pressing releasing layer 32C is made of PFA tube, for example, and covers the pressing elastic layer 32B.

The fixing roller 31 is connected to a motor or the like (not shown) via a gear train and the others, and is driven by the motor to be rotated. The pressing roller 32 is biased by a spring (not shown) via the movable metal plates to be pressed against the fixing roller 31. The pressing roller 32 is driven by the fixing roller 31 to be rotated around an axis to form a nip N between the pressing roller 32 and the fixing roller 31. On an upstream side of the nip N on the conveying path 8, an introducing guide 36 configured to guide the sheet S to the nip N is provided. On a downstream side of the nip N on the conveying path 8, a separating plate 37 configured to separate the sheet S from the fixing belt 31C after the sheet S is passed through the nip N is provided.

As shown in FIG. 2, the heating unit 33 is arranged on an opposite side to the nip N across the fixing roller 31. The heating unit 33 includes a holder 40, a plurality of IH coils 41, an arch core 42 and a plurality of holder biasing members 43 (refer to FIG. 4).

The holder 40 is made of heat resistant resin, for example. The holder 40 is provided with a gap G1 from the fixing roller 31 (an outer face of the fixing roller 31). The gap G1 is set to be about 1.5 mm, for example.

As shown in FIG. 3, the holder 40 includes a holder main body 40A and a pair of holder abutting parts 40B.

The holder main body 40A is formed in an approximate half cylindrical shape so as to cover the fixing roller 31. The holder main body 40A is supported by the pair of front and rear metal plates. As shown in FIG. 3 and FIG. 4, the pair of holder abutting parts 40B are provided in both front and rear portions of the holder main body 40A. The pair of holder abutting part 40B each have two holder projections 40C separated away in a rotating direction of the fixing roller 31. The two holder projections 40C of each holder abutting part 40B come into contact with an outer face of each bearing 30A of the positioning member 30.

As shown in FIG. 2, the plurality of IH coils 41 are supported by the holder 40 (the holder main body 40A). The plurality of IH coils 41 are a heat source configured to heat a surface (the fixing belt 31C) of the fixing roller 31. The arch core 42 is made of ferromagnetic material, such as ferrite, and formed into an approximate half cylindrical shape so as to cover the plurality of IH coils 41. The arch core 42 is supported by the holder main body 40A. The arch core 42 is a member configured to form magnetic path through which magnetic flex produced by each IH coil 41 is passed.

As shown in FIG. 4, the plurality of (a pair of) holder biasing members 43 are coil springs, for example, and are arranged at both front and rear end portions of the holder main body 40A. Each of the holder biasing members 43 is bridged between a spring seat 2A of the apparatus main body 2 and the holder main body 40A. The two holder abutting parts 40B (the holder projections 40C) are biased by each holder biasing member 43 to be pressed against the bearing 30A (refer to FIG. 3). This positions each IH coil 41 with respect to the fixing roller 31 with a desirable gap so that the fixing roller 31 can be heated suitably.

<Operation of the fixing device> With reference to FIG. 2, an operation of the fixing device 7 will be described. The fixing roller 31 is driven by the motor to be rotated around the axis, and the pressing roller 32 is driven by the fixing roller 31 to be rotated around an axis. Each IH coil 41 is supplied with electrical power to produce high frequency magnetic field and to heat the rotating fixing belt 31C. At the image forming operation, the sheet S on which the toner image is transferred is passed through the nip N. The fixing roller 31 heats the toner image on the sheet S passing through the nip N while rotating around the axis. The pressing roller 32 presses the sheet S passing through the nip N while rotating around the axis. Thereby, the toner image is fixed to the sheet S. In the present embodiment, the fixing roller 31 is driven to be rotated. However, the pressing roller 32 may be driven to be rotated and the fixing roller 31 may be driven by the pressing roller 32 to be rotated.

The fixing belt 31C of the fixing roller 31 is made of electric insulating PFA tube, for example, and is therefore electrified to an negative polarity by friction with the sheet S passing through the nip N. Then, the positive polarity toner on the sheet S adheres to the fixing belt 31C and then is transferred to the sheet S passing the nip N. This causes an offset phenomenon. Therefore, the fixing device 7 according to the first embodiment includes the charging unit 34 configured to electrify the fixing roller 31 (the fixing belt 31C) to the same polarity (a positive polarity) as the toner of the toner image.

Figure 5:
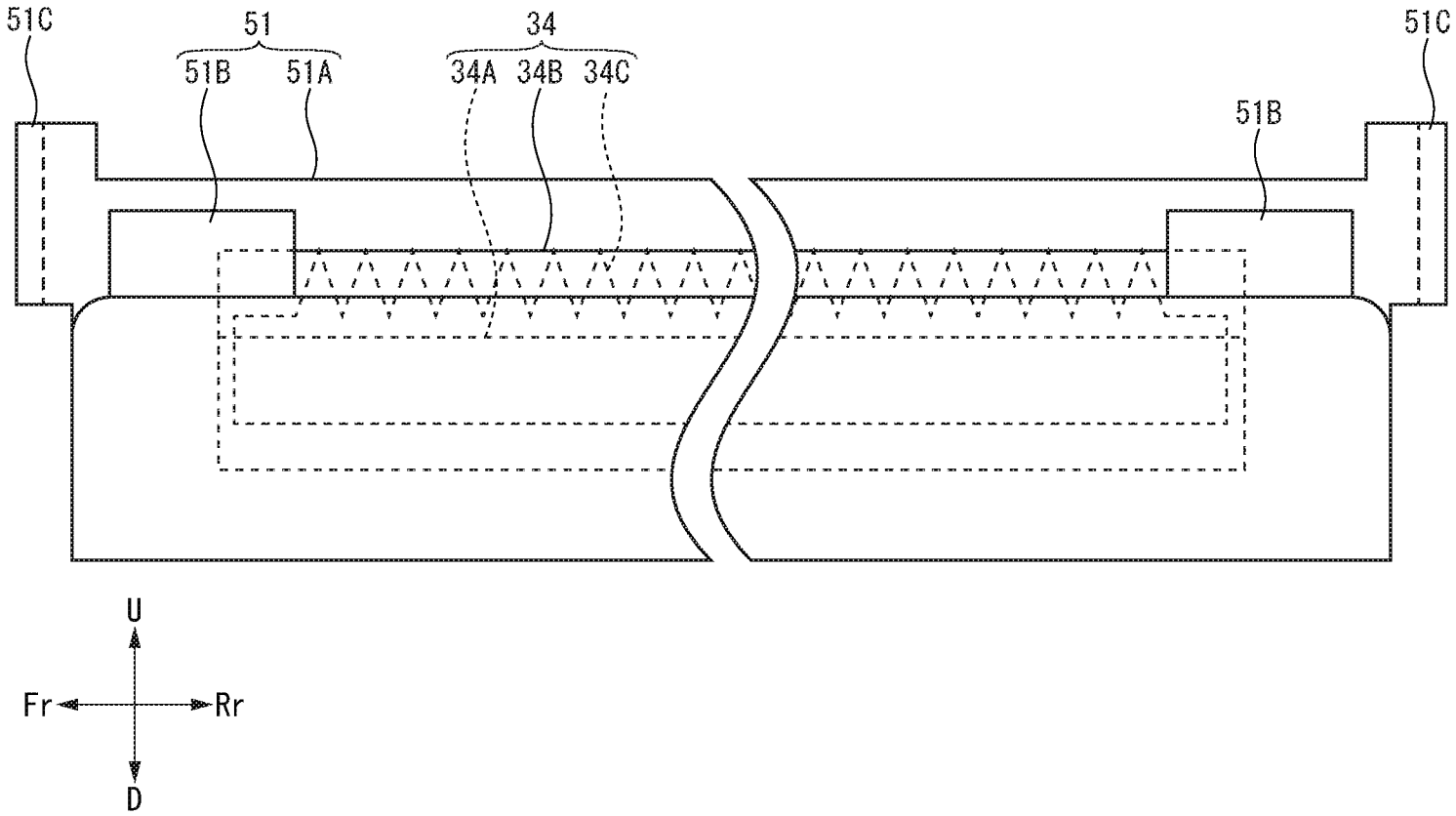
FIG. 5 is a side view showing a charging unit and a supporting member of the fixing device according to the first embodiment of the present disclosure.

<Configuration of the charging device> With reference to FIG. 2 and FIG. 5, the charging unit 34 will be described. FIG. 5 is a side view showing the charging unit 34 and the others. In the following description, "an upstream", "a downstream" or the like respectively show "an upstream", "a downstream" or the like in the rotating direction of the fixing roller 31.

As shown in FIG. 2, the charging unit 34 is arranged near the upstream side of the nip N on the conveying path 8. In other words, the charging unit 34 is arranged on the downstream side of the nip N in the rotating direction. The charging unit 34 includes a charging needle 34C supported by a shield 34B via an electric insulating supporting body 34A. The charging unit 34 is a scorotron charging device which generates corona discharge using the charging needle 34*c* as an example of a needle-shaped electrode. The charging unit 34 is supported by the pair of metal plates in a posture where the charging needle 34C faces the fixing roller 31. As shown in FIG. 5, the charging needle 34C extends along an axis direction of the fixing roller 31 (the front-and-rear direction). The charging needle 34C is formed into an approximate comb-like shape in which a plurality of triangular-shaped needles are aligned in the front-and-rear direction.

By the way, the toner contains wax in order to inhibit the melted toner by being heated and pressed from adhering to the fixing roller 31. At the fixing operation, the wax is volatilized from the toner image (the toner) into a floating matter floating around the fixing roller 31 and the others. In some cases, the floating matter is carried by air flow generated by the rotating of the fixing roller 31 and introduced along the gap G1 between the fixing roller 31 and the holder 40 (refer to a chain line arrow in FIG. 2). If the floating matter adheres to the charging needle 34C, it become impossible to generate suitable corona discharge and it becomes difficult to electrify the fixing belt 31C evenly in the axis direction. Therefore, the fixing device 7 according to the first embodiment includes the adsorbing unit 35 configured to collect the floating matter.

Figure 6:
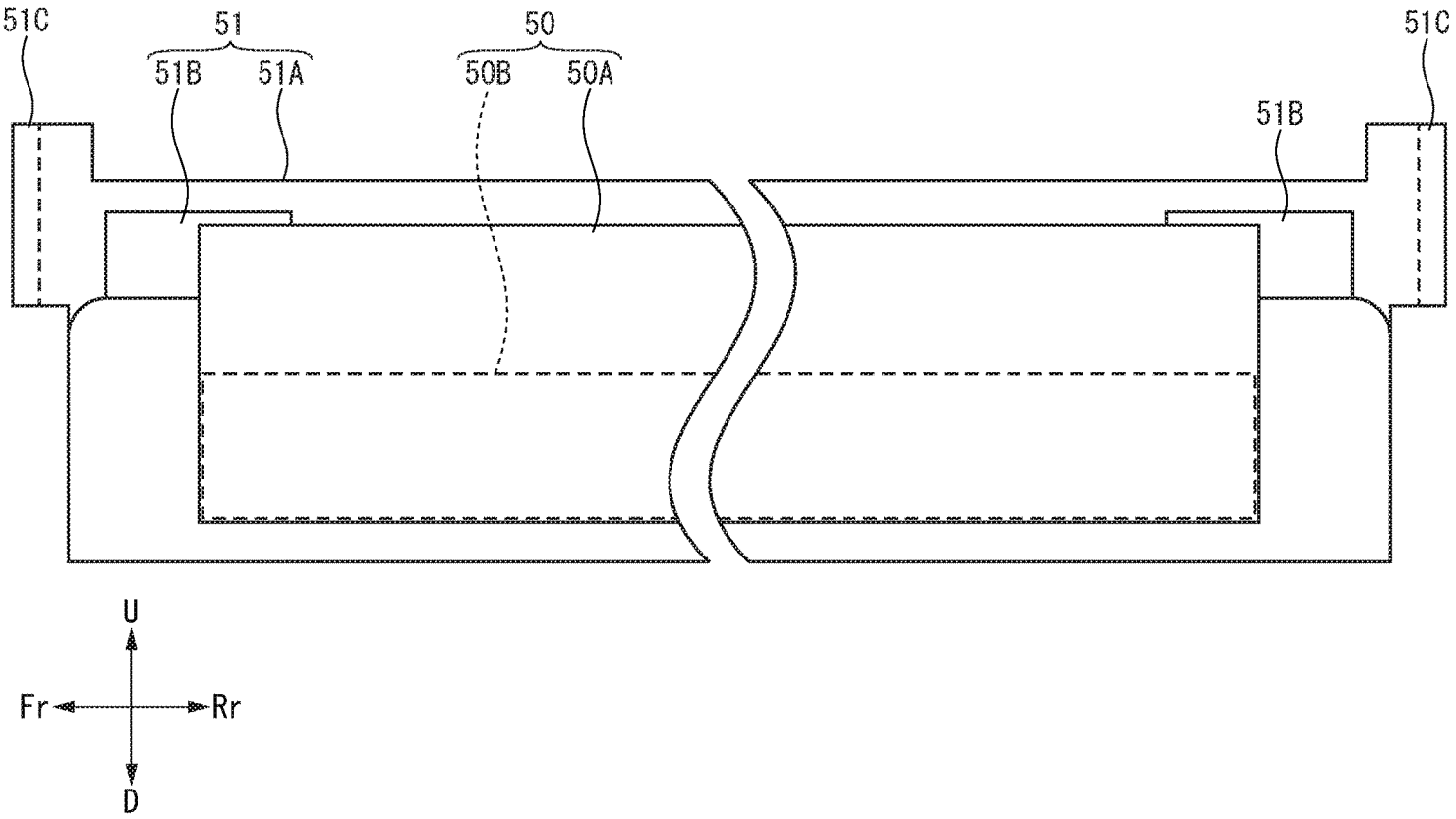
FIG. 6 is a side view showing an adsorbing member and the supporting member of the fixing device according to the first embodiment of the present disclosure.
Figure 7:
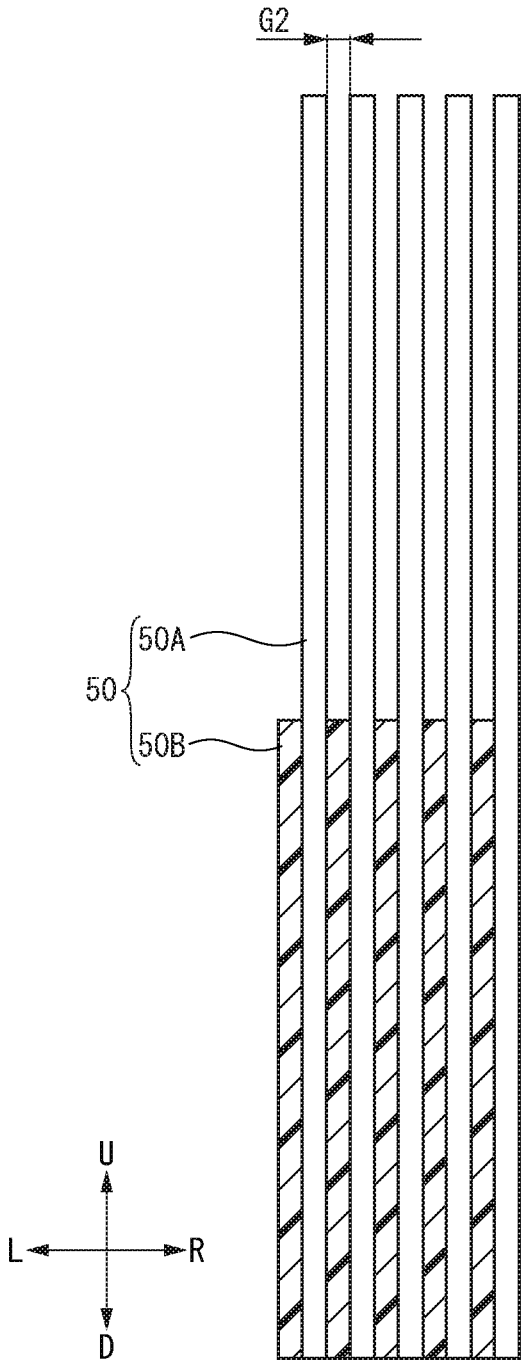
FIG. 7 is a front view showing the adsorbing member of the fixing device according to the first embodiment of the present disclosure.

<Configuration of the adsorbing unit> With reference to FIG. 2, FIG. 5 to FIG. 7, the adsorbing unit 35 will be described. FIG. 6 is a side view showing an adsorbing member 50 and a supporting member 51. FIG. 7 is a front view showing the adsorbing member 50.

As shown in FIG. 2, the adsorbing unit 35 includes the adsorbing member 50, the supporting member 51 and a plurality of biasing members 52. The adsorbing member 50 adsorbs the floating matter. The supporting member 51 supports the adsorbing member 50 so as to be close to the fixing roller 31. Each of the biasing members 52 biases the supporting member 51 toward the fixing roller 31.

As shown in FIG. 6 and FIG. 7, the adsorbing member 50 includes a plurality of (for example, five) adsorbing sheets 50A and a plurality of (for example, five) spacers 50B.

Each of the adsorbing sheets 50A is formed into an approximate rectangular shape elongated in the front-and-rear direction. The plurality of adsorbing sheets 50A have the same size and shape. Each adsorbing sheet 50A is made by processing activated carbon fiber or activated carbon powder (particle) into a sheet. The activated carbon contained in each adsorbing sheet 50A adsorbs the floating matter. As the adsorbing sheet 50A, a sheet (having a thickness of 0.5 to 1 mm) in which activated carbon is dispersed in a paper sheet approximate evenly by paper making technique, a sheet (having a thickness of 1 to 3 mm) in which activated carbon is coated on a fiver sheet, such as a nonwoven fabric, or a sheet (having a thickness of 1 to 3 mm) in which activated carbon is sandwiched between nonwoven fabrics may be employed.

Each of the spacers 50B is made of resin material, such as PET film, for example, and formed in an approximate rectangular shape elongated in the front-and-rear direction. Each spacer 50B has a width narrower than a width of the adsorbing sheet 50A. For example, the width of the spacer 50B is about a half of the width of the adsorbing sheet 50A. The plurality of spacers 50B are each provided between the adsorbing sheets 50A. Each spacer 50B is formed into a sheet on both faces of which have an adhesion layer. Each spacer 50B adheres to an approximate lower half portion of each of the adjacent arranged adsorbing sheets 50A. The plurality of spacers 50B make the plurality of adsorbing sheets 50A to be overlapped via gaps G2 (refer to FIG. 7) to forma laminate. The gap G2 (a thickness of the spacer 50B) has a size larger than a size of the floating matter.

The plurality of adsorbing sheets 50A are overlapped via the spacer 50B along the rotating direction of the fixing roller 31 (refer to FIG. 2). The plurality of adsorbing sheets 50A are overlapped in a state where their tip edges are aligned (refer to FIG. 7).

As shown in FIG. 2, the supporting member 51 is arranged on the downstream side of the adsorbing member 50 in the rotating direction. The supporting member 51 includes a supporting member main body 51A and a pair of abutting parts 51B.

The supporting member main body 51A is formed into a box-like shape elongated in the front-and-rear direction. In detail, the supporting member main body 51A is formed into a box-like shape having an opening which faces the fixing roller 31 and an arrangement space SP in which the charging unit 34 is arranged. That is, the supporting member main body 51A is formed into an approximate U-shape in which the fixing roller 31 side face is opened, viewed from the front side. The charging unit 34 is arranged in the arrangement space SP in a posture where the charging needle 34C faces the fixing roller 31 through the opening (refer to FIG. 5 also).

As shown in FIG. 2, FIG. 5 and FIG. 6, on both front and rear end portions of a left side wall of the supporting member main body 51A, a pair of bearing pieces 51C is formed. The pair of bearing pieces 51C is supported by supporting shafts (not shown) protruding from the pair of metal plates. The supporting member main body 51A is movable in directions to approach to or to separate from the fixing roller 31.

As shown in FIG. 2 and FIG. 6, to an outer face of a right side wall of the supporting member main body 51A, the adsorbing member 50 adheres via the spacer 50B. Accordingly, the adsorbing member 50 is arranged on the downstream side of the nip N in the rotating direction and on the upstream side of the charging unit 34 in the rotating direction. The adsorbing member 50 is fixed to the supporting member man body 51A in a posture where openings of the gaps G2 face the fixing roller 31. The adsorbing member 50 (the tip edge of each adsorbing sheet 50A) is supported by the supporting member 51 (the supporting member main body 51A) in an extended state so as to cross the gap G1. A gap G3 between the tip edge of each adsorbing sheet 50A and the outer face of the fixing roller 31 is set to be about 1 mm, for example.

The pair of abutting parts 51B is provided on both front and rear end portions of an inner face (a face on the arrangement space SP side) of the right side wall of the supporting member main body 51A. The pair of abutting parts 51B comes into contact with both end portions in the axis direction of the fixing roller 31. The both end portions of the fixing roller 31 are non-sheet passing areas R through which the sheet S is not passed (refer to FIG. 4). Each abutting part 51B extends toward the fixing roller 31 further than the right side wall of the supporting member main body 51A. A tip portion of each abutting part 51B is formed into an approximate column elongated in the front-and-rear direction.

As shown in FIG. 2, the plurality of (the pair of) biasing members 52 are coil springs, for example, and arranged on the both front and rear end portions of the supporting member main body 51A. Each biasing member 52 is bridged between a guide seat 36A formed in the introducing guide 36 and the left side wall of the supporting member 51. The supporting member main body 51A is applied with biasing force of each biasing member 52 to be rotated in a direction of approaching the fixing roller 31 around the pair of supporting shafts (the bearing pieces 51C). Then, the pair of abutting parts 51B come into contact with the fixing belt 31C. As described above, each biasing member 52 biases the supporting member main body 51A to the fixing roller 31, and keeps a state where the pair of abutting parts 51B, which is a part of the supporting member 51, comes into contact with the outer face of the fixing roller 31.

<Operation and effect of the fixing device> The floating matter generated at the fixing operation is introduced to the gap G1 between the fixing roller 31 and the holder 40 and flows toward the downstream side in the rotating direction (refer to the chain line arrow in FIG. 2). Because the tip edge portions of the plurality of adsorbing sheets 50A are provided close to the outer face of the fixing roller 31, the floating matter introduced in the gap G1 abuts against the tip edge portion of each adsorbing sheet 50A and is blocked. Then, the floating matter is flowed into the gaps G2 between the adsorbing sheets 50A and adsorbed by each adsorbing sheet 50A.

As described above, in the fixing device 7 according to the first embodiment, the supporting member 51 is kept in the state where the pair of abutting parts 51B, which is a part of the supporting member 51, comes into contact with the outer face of the fixing roller 31. Accordingly, it becomes possible to keep a gap between the adsorbing member 50 supported by the supporting member 51 and the fixing roller 31 approximate constant. Additionally, in a space between the downstream side of the nip N and the upstream side of the charging unit 34, the adsorbing member 50 can be supported by the supporting member 51 in a state being close to the fixing roller 31. The floating matter carried along the outer face of the rotating fixing roller 31 is caught by the adsorbing member 50 before they reaches the charging unit 34. This makes it possible to prevent the floating matter from adhering to the charging needle 34C of the charging unit 34 so that suitable charging performance of the charging unit 34 can be kept for a long period.

Additionally, the fixing device 7 according to the first embodiment has a configuration that the supporting member main body 51A is biased by each biasing member 52 to be rotated toward the fixing roller 31 and the pair of abutting parts 51B is pressed against the non-sheet passing areas R of the fixing roller 31. By applying such a configuration, because the pair of abutting parts 51B comes into contact with the fixing roller 31 as an object to be positioned and supports the fixing roller 31, it becomes possible to keep the gap between the supporting member 51 and the fixing roller 31 approximate constant. Thereby, it becomes possible to support the adsorbing member 50 in the state of being close to the outer face of the fixing roller 31 so that the adsorbing member 50 can adsorb the floating matter carried along the outer face of the fixing roller 31 effectively.

The fixing device 6 according to the first embodiment has a configuration that the charging unit 34 is arranged so as to be contained in the supporting member main body 51A and the adsorbing member 50 is supported by the supporting member main body 51A near the upstream side of the charging unit 34. By applying such a configuration, the adsorbing member 50 can adsorb the floating matter carried through the gap G1 just before the floating matter reaches the charging unit 34. This makes it possible to catch the floating matter effectively.

The fixing device 7 according to the first embodiment has a configuration that the adsorbing member 50 is arranged such that the tip edge portion of the adsorbing member 50 crosses the gap G1. By applying such a configuration, the adsorbing member 50 makes it possible to block the floating matter carried along the outer face of the rotating fixing roller 31 and catch it effectively. Thereby, it becomes possible to reduce an amount of the floating matter which reaches the charging unit 34 and to inhibit the floating matter from adhering to the charging needle 34C.

The fixing device 7 according to the first embodiment has a configuration that the adsorbing member 50 is formed by overlapping the plurality of adsorbing sheets 50A and the plurality of spacers 50B alternately. By applying such a configuration, the adsorbing member 50 makes it possible to adsorb the floating matter introduced into the gaps G2 between the adsorbing sheets 50A. By overlapping the plurality of adsorbing sheets 50A via the gaps G2, it becomes possible to increase an area capable of adsorbing the floating matter. Thereby, it becomes possible to increase an amount of the adsorbed floating matter and to keep the floating matter adsorbing performance for a long period.

Figure 8:
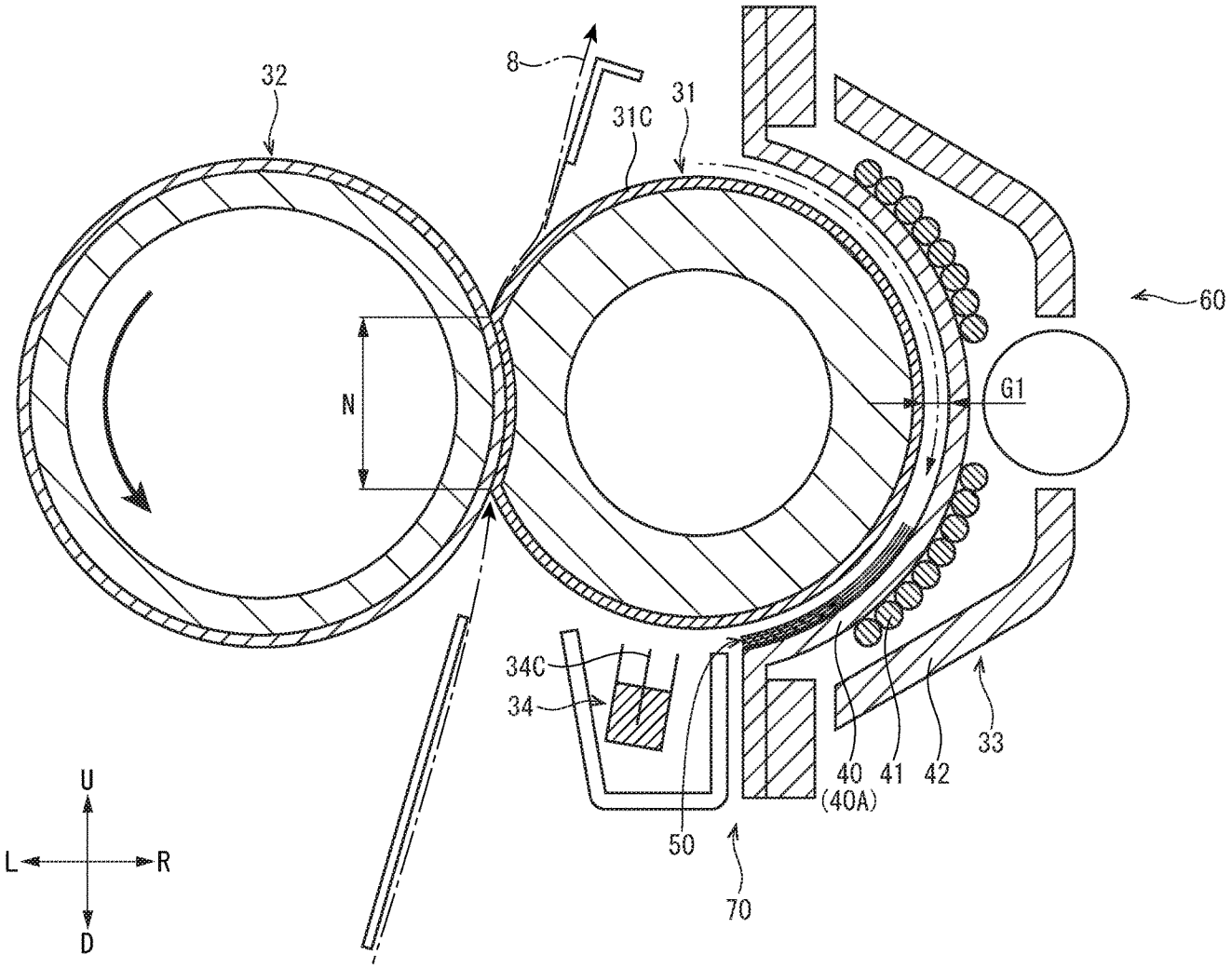
FIG. 8 is a sectional view schematically showing the fixing device according to a second embodiment of the present disclosure.

<A Second Embodiment> Next, with reference to FIG. 3. FIG. 4 and FIG. 8, the fixing device 60 according to a second embodiment will be described. In the following description, the same configurations as the fixing device 7 according to the first embodiment are shown by the same reference number as the first embodiment, and their explanation is omitted.

As shown in FIG. 8, the fixing device 60 does not include the adsorbing unit 35 (the supporting member 51, the biasing member 52 and the others) of the fixing device 7 according to the first embodiment. The adsorbing unit 70 of the fixing device 60 includes the adsorbing member 50, the holder 40 and the plurality of holder biasing members 43 (refer to FIG. 4).

The holder main body 40A of the holder 40 as an example of a supporting member supports the adsorbing member 50 in the gap G1 so as to face the fixing roller 31. The adsorbing member 50 adheres to the holder main body 40A via the spacer 50B near the upstream side of the charging unit 34. The adsorbing member 50 is fixed to the holder main body 40A in a posture where the opening of each gap G2 faces the upstream side in the rotating direction. As shown in FIG. 3 and FIG. 4, each holder biasing member 43 (a biasing member) biases the holder 40 toward the fixing roller 31 to keep a state where the pair of holder abutting parts 40B (the holder projection 40C) comes into contact with the positioning member 30 (the bearing 30A).

The pair of bearings 30A of the positioning member 30 is fixedly attached to the metal plate with a high precision in order to rotate the fixing roller 31 smoothly. As described above, the fixing device 7 according to the second embodiment has a configuration that the pair of holder abutting part 40*b* (a part of the supporting member) is abutted against the pair of bearings 30A so that the holder 40 can be positioned with a high precision. By applying such a configuration, it becomes possible to keep the gap G1 between the holder main body 40A and the fixing roller 31 approximate constant by the pair of holder abutting parts 40B as the support so that the adsorbing member 50 can be supported by the holder main body 40A in a state of being close to the fixing roller 31. Thereby, the adsorbing member 50 can adsorb the floating matter effectively so that it becomes possible to inhibit the floating matter from adhering to the charging unit 34.

Figure 9:
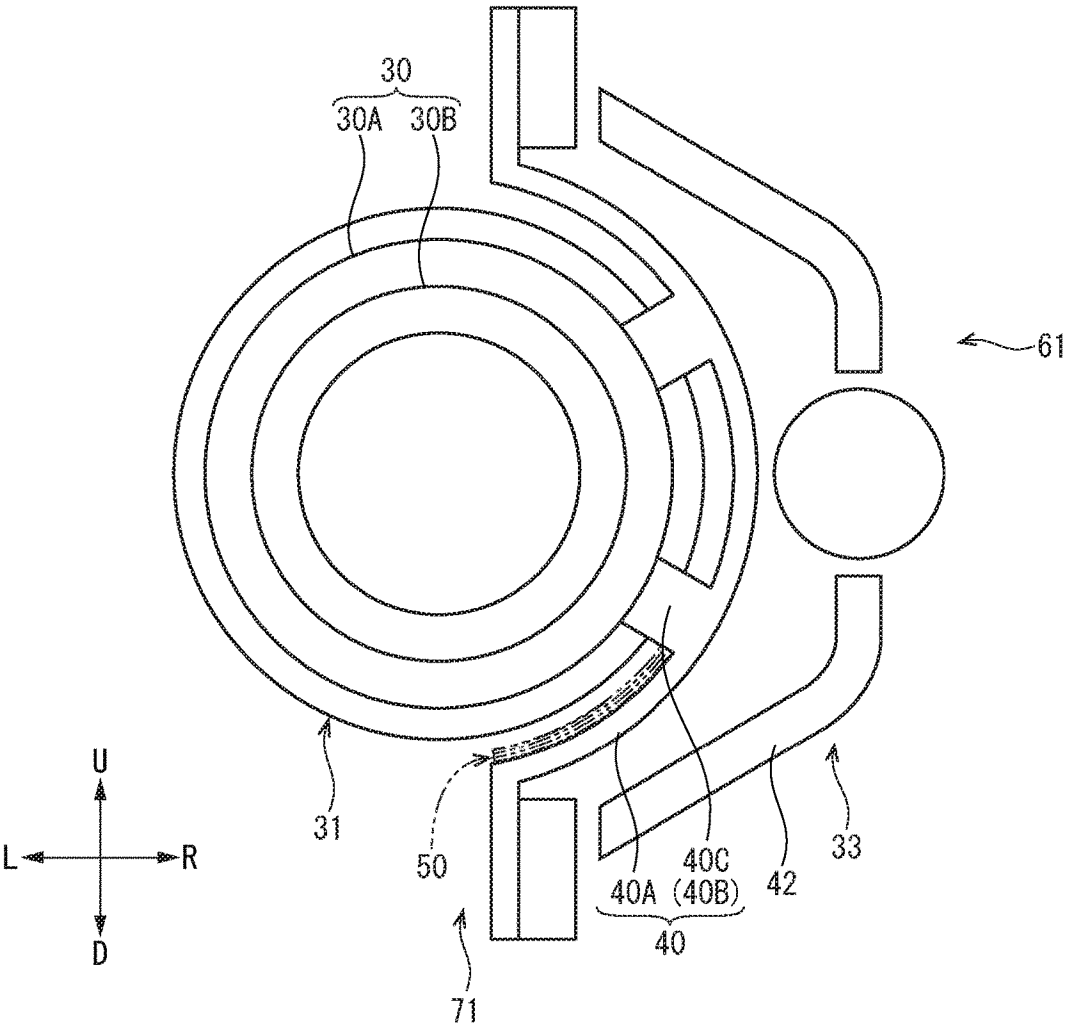
FIG. 9 is a front view schematically showing the fixing roller and the others of the fixing device according to a third embodiment of the present disclosure.

<A Third Embodiment> Next, with reference to FIG. 9, the fixing device 61 according to the third embodiment will be described. FIG. 9 is a front view schematically showing the fixing roller 31 and the others of the fixing device 61. In the following description, the same configurations as the fixing devices 7 and 60 according to the first embodiment and the second embodiment are shown by the same reference number as the first embodiment and the second embodiment, and their explanation is omitted.

The fixing device 61 does not includes the adsorbing unit 35 of the fixing device 7 according to the first embodiment and the plurality of holder biasing member 43 of the fixing device 60 according to the second embodiment. The adsorbing unit 71 of the fixing device 61 includes the adsorbing member 50 and the holder 40 (the supporting member). The holder main body 40A of the holder 40 is provided in a state where the pair of holder abutting parts 40B (each holder projection 40C) is fixed (for example, adhesion or fastening using a screw) to the pair of bearings 30A of the positioning member 30. The holder main body 40A supports the adsorbing member 50 in a state where the adsorbing member 50 is close to the fixing roller 31 (a posture where the adsorbing member 50 faces the fixing roller 31).

As described above, the fixing device 61 according to the third embodiment has a configuration that the pair of holder abutting parts 40B (a part of the supporting member) is fixed to the pair of bearings 30A so that the holder 40 can be positioned with a high precision. By applying such a configuration, it becomes possible to keep the gap G1 between the holder main body 40A and the fixing roller 31 approximate constant so that the adsorbing member 50 can be supported by the holder main body 40A in the state of being close to the fixing roller 31. Thereby, the adsorbing member 50 adsorbs the floating matter effectively so that it becomes possible to prevent the floating matter from adhering to the charging unit 34.

Figure 10:
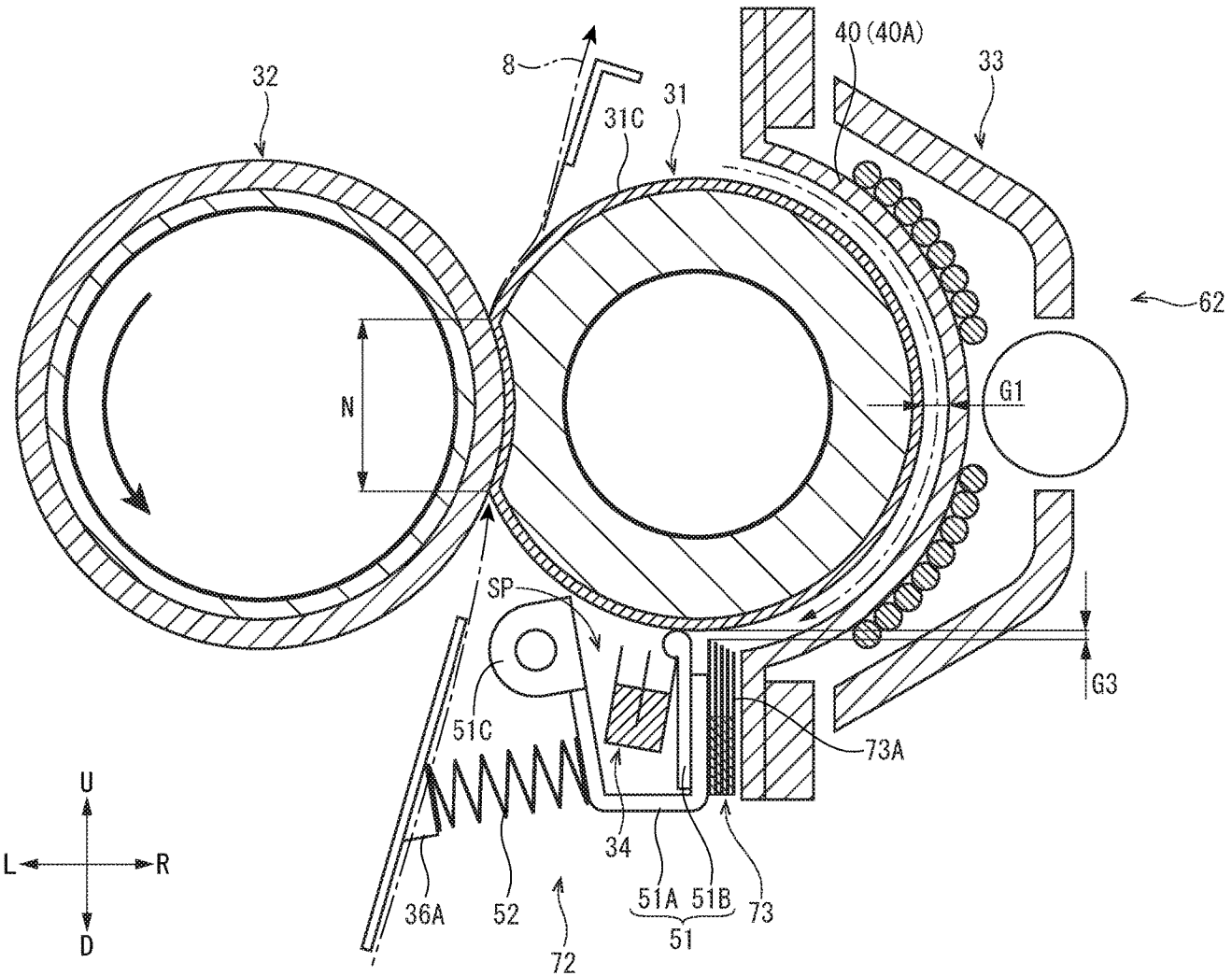
FIG. 10 is a sectional view schematically showing the fixing device according to a fourth embodiment of the present disclosure.
Figure 11:
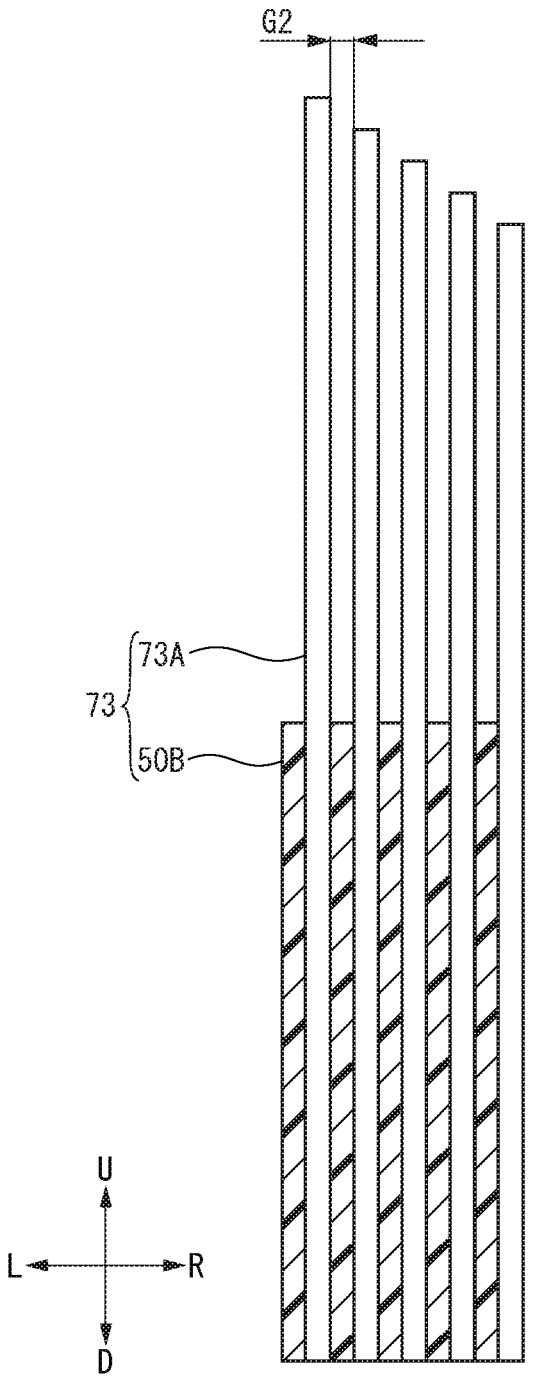
FIG. 11 is a front view showing the adsorbing member of the fixing device according to the fourth embodiment of the present disclosure.

<A Fourth Embodiment> Next, with reference to FIG. 10 and FIG. 11, the fixing device 62 according to the fourth embodiment will be described. FIG. 10 is a sectional view schematically showing the fixing device 62. FIG. 11 is a front view showing the adsorbing member 73 of the fixing device 62. In the following description, the same configurations as the fixing device 7 according to the first embodiment are shown by the same reference number as the first embodiment, and their explanation is omitted.

In the adsorbing member 50 of the fixing device 7 according to the first embodiment, the plurality of adsorbing sheets 50A have the same size and shape. On the other hand, in the adsorbing member 73 of the fixing device 62 according to the fourth embodiment, the plurality of adsorbing sheets 73A have different sizes.

The adsorbing unit 72 of the fixing device 62 includes the adsorbing member 73 that the plurality of adsorbing sheets 73A and the plurality of spacers 50B are overlapped alternately along the rotating direction of the fixing roller 31. The plurality of adsorbing sheets 73A are formed into approximate rectangular shapes each having a different width (length) in the upper-and-lower direction. The plurality of adsorbing sheets 73A are overlapped from the upstream side to the downstream side in the rotating direction in the order that the width (the length) is gradually increased. The plurality of adsorbing sheets 73A are overlapped in a state where their tip edges are displaced in an approximate stepped shape. A gap G3 between the tip edge of the adsorbing sheet 73A arranged the most downstream side and the outer face of the fixing roller 31 is set to be about 1 mm.

As described above, the adsorbing member 73 of the fixing device 62 according to the fourth embodiment has a configuration that the adsorbing sheet 73A arranged on the downstream side in the rotating direction extends closer to the fixing roller 31 than the adsorbing sheet 73A arranged on the upstream side in the rotating direction. Thereby, the tip edges of the plurality of adsorbing sheets 73A are arranged in the stepped shape so as to approach the fixing roller 31 from the upstream side to the downstream side in the rotating direction. By applying such a configuration, the floating matter carried through the gap G1 abuts on the step-shaped arranged tip portions of the adsorbing sheets 73A successively and then guided by the abutted adsorbing sheet 73A into the gap G2. This permits the floating matter to be adsorbed by the adsorbing member 73 effectively.

The adsorbing member 73 of the fixing device 62 according to the fourth embodiment can be applied to the fixing devices 7, 60 and 61, in replace for the adsorbing member 50 according to the first to third embodiments.

In the fixing devices 7, and 60 to 62 according to the first to fourth embodiments, the adsorbing members 50 and 73 are arranged on the downstream side of the heating unit 33 in the rotating direction. However, the present disclosure is not limited to the embodiments. The adsorbing members 50 and 73 may be arranged within an area from the downstream side of the nip N in the rotating direction to the upstream side of the charging unit 34 in the rotating direction.

In the fixing devices 7, and 60 to 62 according to the first to fourth embodiments, the gap G1 between the holder main body 40A and the outer face of the fixing roller 31 is set to be about 0.5 mm. In the fixing devices 7 and 62 according to the first and fourth embodiments, the gap G3 between the tip edge of each of the adsorbing sheets 50A and 73A and the outer face of the fixing roller 31 is set to be about 1 mm. However, the present disclosure is not limited to the embodiments. The gap G1 and the gap G3 may be increased or decreased suitably.

In the fixing devices 7, and 60 to 62 according to the first to fourth embodiments, the biasing member 52 (the holder biasing member 43) biases the supporting member 51 (the holder 40) toward the fixing roller 31. However, the present disclosure is not limited to the embodiments. For example, each abutting part 51B (each holder abutting part 40B) may come into contact with the outer face of the fixing roller 31 by weight of the supporting member 51 (the holder 40) or the others.

In the fixing devices 7, and 60 to 62 according to the first to fourth embodiments, the pair of abutting parts 51B (the pair of holder abutting parts 40B (the four holder projections 40C)) are provided. However, the present disclosure is not limited to the embodiments. One or more of the abutting parts 51B (the holder abutting parts 40B and the holder projections 40C) may be provided.

In the fixing devices 7, and 60 to 62 according to the first to fourth embodiments, the adsorbing members 50 and 73 uses the sheet-shaped spacer 50B. However, a both-sided adhesion tape may be used in replace for the spacer 50B. The adsorbing members 50 and 73 are formed by overlapping five of the adsorbing sheets 50A and 73A. However, the present disclosure is not limited to the embodiments. Two or more of the adsorbing sheets 50A and 73A (the spacer 50B) may be provided.

In the fixing devices 7, and 60 to 62 according to the first to fourth embodiments, the fixing belt 31C forms the outer face of the fixing roller 31. However, the present disclosure is not limited to the embodiments. The fixing member may be configured such that the fixing belt is wound around a plurality of rollers (not shown). Additionally, the charging unit 34 includes the approximate comb-shaped electrode. However, the present disclosure it not limited to the embodiments. The charging unit 34 may include a discharge wire as an electrode provided on an electric insulating member. Alternatively, the charging unit 34 may be a corotron charging device.

In the fixing devices 7, and 60 to 62 according to the first to fourth embodiments, the toner is electrified to the positive polarity. However, the present disclosure is not limited to the embodiments. The toner may be electrified to the negative polarity. In this case, the charging unit 34 preferably electrifies the outer face of the fixing roller 31 to the negative polarity.

In the fixing devices 7, and 60 to 62 according to the first to fourth embodiments, the adsorbing members 50 and 73 adsorb the wax component of the toner, as an example of the floating matter. However, the present disclosure is not limited to the embodiments. For example, the adsorbing members 50 and 73 may adsorb the floating matter containing volatile organic compound or the like produced when the toner (the toner image) is heated. Alternatively, the adsorbing members 50 and 73 may adsorb discharge product, such as ozone, produced at the corona discharging of the charging unit 34. The adsorbing members 50 and 73 are provided on the fixing devices 7, and 60 to 62. However, the present disclosure is not limited to the embodiments. The adsorbing members 50 and 73 may be provided on a corotron charging device or a scorotron charging device which electrifies the photosensitive drum 20. In this case, it becomes possible to adsorb the discharge product (ozone or the others) produced at the corona discharging.

While the preferable embodiment and its modified example of the fixing device and the image forming apparatus of the present disclosure have been described above and various technically preferable configurations have been illustrated, a technical range of the disclosure is not to be restricted by the description and illustration of the embodiment.

The invention claimed is:

1. An adsorbing member comprising:

a plurality of adsorbing sheets which adsorb a floating matter; and a plurality of spacers each provided between the adsorbing sheets to form a laminate that the plurality of adsorbing sheets are overlapped via a gap, wherein the plurality of adsorbing sheets are overlapped along a rotating direction of a rotating member rotating around an axis, and the plurality of adsorbing sheets are provided around the rotating member in a state where an opening of the gap faces the rotating member and the adsorbing sheet arranged on a downstream side in the rotating direction of the rotating member extends closer to the rotating member than the adsorbing sheet arranged on an upstream side in the rotating direction of the rotating member.

2. A fixing device comprising:

a fixing member heating a toner image on a medium while rotating around an axis;

a pressing member forming a nip with the fixing member and pressing the medium passing through the nip while rotating around an axis;

a charging unit electrifying the fixing member to the same polarity as a toner of the toner image; and an adsorbing member provided on an upstream side of the nip in a rotating direction of the fixing member and on the upstream side of the charging unit in the rotating direction of the fixing member, wherein the adsorbing member includes:

a plurality of adsorbing sheets which adsorb a floating matter floating around the fixing member; and a plurality of spacers each provided between the adsorbing sheets to form a laminate that the plurality of adsorbing sheets are overlapped via a gap, wherein the plurality of adsorbing sheets are overlapped along the rotating direction of the fixing member, and the plurality of adsorbing sheets are provided around the fixing member in a state where an opening of the gap faces the fixing member, wherein the adsorbing sheet arranged on the downstream side in the rotating direction of the fixing member extends closer to the fixing member than the adsorbing sheet arranged on the upstream side in the rotating direction of the fixing member.

3. The fixing member according to claim 2, comprising:

a supporting member supporting the adsorbing member; and an abutting part which makes the supporting member abut against the fixing member at an area through which the medium is not passed, wherein the charging unit is stored in the supporting member.

4. A fixing device comprising:

a fixing member heating a toner image on a medium while rotating around an axis;

a pressing member forming a nip with the fixing member and pressing the medium passing through the nip while rotating around an axis;

a charging unit electrifying the fixing member to the same polarity as a toner of the toner image;

a heat source arranged on an upstream side of the charging unit in a rotating direction of the fixing member and heating the tonner on the medium; and an adsorbing member provided on the upstream side of the nip in the rotating direction of the fixing member and on the upstream side of the charging unit in the rotating direction of the fixing member, wherein the plurality of adsorbing sheets are overlapped along a radial direction of the fixing member, and the plurality of adsorbing sheets are provided around the fixing member in a state where an opening of the gap faces the upstream side in the rotating direction of the fixing member, wherein the heat source includes:

an IH coil; and a holder supporting the IH coil and arranged around the fixing member with a gap, wherein the adsorbing member is provided on an inner face of the holder.

* * * * *